US007587790B2

(12) United States Patent
McCue et al.

(10) Patent No.: US 7,587,790 B2
(45) Date of Patent: Sep. 15, 2009

(54) ADJUSTABLE RIGID CORNER GUARD

(75) Inventors: David S. McCue, Manchester, MA (US); Daniel B. Ballou, Salem, MA (US); Adam P. Stevens, York, ME (US); Brent Hild, Belmont, MA (US); Teodoro A. Mesa, Lynn, MA (US); Genesis J. McDermott, Chicago, IL (US)

(73) Assignee: McCue Corporation, Salem, MA (US)

( * ) Notice: Subject to any disclaimer, the term of this patent is extended or adjusted under 35 U.S.C. 154(b) by 77 days.

(21) Appl. No.: 11/633,935

(22) Filed: Dec. 5, 2006

(65) Prior Publication Data

US 2008/0010780 A1 Jan. 17, 2008

Related U.S. Application Data

(60) Provisional application No. 60/742,660, filed on Dec. 6, 2005.

(51) Int. Cl.
*A47G 1/10* (2006.01)

(52) U.S. Cl. ..... 16/404; 404/9; 248/345.1

(58) Field of Classification Search ..... 404/6, 404/9; 16/404, DIG. 2; 248/345.1; 52/288.1, 52/245, 291; 116/63 P; 49/460, 462; 405/211–216; 172/512; 40/606.11, 606.12; 160/135, 351
See application file for complete search history.

(56) References Cited

U.S. PATENT DOCUMENTS

| | | | | |
|---|---|---|---|---|
| 819,338 | A * | 5/1906 | Claridge | 40/607.13 |
| 1,999,920 | A | 4/1935 | Wolfson | |
| 3,952,453 | A * | 4/1976 | Amburgey | 49/34 |
| 4,198,036 | A * | 4/1980 | O'Neal | 267/140 |
| 4,979,554 | A * | 12/1990 | Nelson | 160/135 |
| 5,018,902 | A | 5/1991 | Miller et al. | |

(Continued)

FOREIGN PATENT DOCUMENTS

| | | |
|---|---|---|
| FR | 2424982 | 11/1979 |

(Continued)

OTHER PUBLICATIONS

International Search Report for Application No. PCT/US2006/046406, dated Mar. 29, 2007.

(Continued)

*Primary Examiner*—Victor Batson
*Assistant Examiner*—Jeffrey O'Brien
(74) *Attorney, Agent, or Firm*—Lahive & Cockfield, LLP

(57) ABSTRACT

A rigid corner guard protects a corner of a structure from collisions with objects. The corner guard includes a rigid body having a base, an upper end, and a wall extending between the base and the upper end that is configured to surround the corner of the structure. The corner guard also includes a leg structure secured to the rigid body including at least two leg portions adapted to support the rigid body of the corner guard. The separation between the at least two leg portions is at a predetermined distance. The corner guard further includes an adjustment mechanism coupled to the rigid body. The adjustment mechanism is configured to apply a force to the rigid body to flex the rigid body to adjust the predetermined distance for installation of the at least two leg portions. The corner guard is constructed of material with sufficient strength and toughness to withstand collisions with heavier industrial type equipment.

19 Claims, 8 Drawing Sheets

U.S. PATENT DOCUMENTS

| | | | | |
|---|---|---|---|---|
| 5,033,905 | A * | 7/1991 | Schmidt et al. | 404/6 |
| 5,079,805 | A * | 1/1992 | Mlachnik | 24/20 LS |
| 5,507,473 | A * | 4/1996 | Hammer et al. | 256/13.1 |
| 5,566,926 | A * | 10/1996 | Voigt | 256/13.1 |
| 5,816,746 | A * | 10/1998 | Blair | 405/216 |
| 5,891,534 | A * | 4/1999 | Sabin et al. | 428/11 |
| 5,899,628 | A | 5/1999 | Pei-Chi | |
| 6,113,313 | A * | 9/2000 | Blair et al. | 405/216 |
| 6,203,241 | B1 | 3/2001 | Gertz | |
| 6,260,237 | B1 | 7/2001 | McCue et al. | |
| 6,579,034 | B1 * | 6/2003 | Welch et al. | 404/6 |
| 6,619,630 | B2 * | 9/2003 | Albritton | 256/13.1 |
| 6,623,204 | B2 * | 9/2003 | Buehler | 404/6 |
| 6,848,857 | B1 * | 2/2005 | McColl et al. | 404/6 |
| 6,945,730 | B1 | 9/2005 | Lobban | |
| 2005/0152744 | A1 * | 7/2005 | Straub | 404/6 |

FOREIGN PATENT DOCUMENTS

| | | |
|---|---|---|
| GB | 2207692 | 2/1989 |
| JP | 9-100516 | 4/1997 |
| JP | 2001-140228 | 5/2001 |
| KR | 20-0285535 | 7/2002 |
| KR | 20-0403551 | 12/2005 |

OTHER PUBLICATIONS

International Search Report for Application No. PCT/US2008/088151, dated May 27, 2009.

* cited by examiner

ADJUSTABLE RIGID CORNER GUARD

RELATED APPLICATIONS

This application claims priority to, and the benefit of, co-pending U.S. Provisional Application No. 60/742,660, filed Dec. 6, 2005, for all subject matter common to both applications. The disclosure of said provisional application is hereby incorporated herein by reference in its entirety.

FIELD OF THE INVENTION

The present invention relates generally to a corner guard for protecting floor fixtures such as refrigerator cases, product displays, or floor shelving, and the like, from damage, and more particularly to a corner guard employing a rigid body with an extended vertical height for protecting these floor fixtures and legs for mounting the corner guard having an adjustable distance therebetween.

BACKGROUND OF THE INVENTION

In supermarkets and retail stores floor fixtures such as freezer and refrigerator cases, floor shelving, and product displays are susceptible to damage due to collisions with shopping carts, floor scrubbers, pallet jacks, stock carts, and the like. For example, freezer and refrigerator cases typically include a glass or transparent plastic door for viewing the product without opening the door. The glass can be shattered, or the plastic scratched, upon impact with shopping carts, or the like. Since the body of many of these floor fixtures is constructed of lightweight aluminum or hardened plastic, it can be easily dented or cracked by such impacts.

Furthermore, floor fixtures such as shelving are intended to hold product to be sold, and since space is generally at a premium for most retailers, this shelving is typically densely packed with product. When a collision occurs to the shelving, it is possible that the product may be knocked from the shelf resulting in the breakage of glass containers or the denting of cans. In either case, the retailer incurs a loss of product.

In order to protect floor fixtures from collisions and jarring impacts, supermarkets and retail stores have employed protective guards around the fixtures to prevent these occurrences. These guards are conventionally constructed as a horizontally extending aluminum rail, which is mounted into the floor. These rails may be covered with vinyl or include a vinyl insert to provide for impact absorption or add color to the guard. These guards are positioned around the exposed perimeter of the fixture at a distance sufficient to protect the fixture from impact but not hinder access. These guards, however, provide only a limited range of vertical protection for the floor fixture from collision due to the small vertical extension. If the rails on each side of the fixture are not joined at the corner, the fixture will have increased exposure to damage by collision at the corner position, and the retailer may incur increased maintenance costs to repair the fixture.

One style of commonly used protective guard consists of vertical metal posts or formed metal arced shapes mounted to the floor. The vertical metal posts do not envelop the corner, thus narrowing the zone of protection. The formed metal arced shapes can be difficult to mount directly in the floor, often requiring cement to secure them in place.

Another style of protective guard consists of a corner guard having a hollow plastic body with a rear wall shaped to conform to the corner of a protected structure, and a front wall shaped to surround the corner. An example of such a protective guard is shown in U.S. Pat. No. 6,260,237, which is hereby incorporated herein by reference to the extent that it shows the use of the corner guard device generally. A leg structure is secured to the rear wall, the leg structure having at lease one leg portion for supporting the corner guard on the floor. The corner guard can have a metal horizontal rail secured to the front wall of the body, having a surface that extends outwardly from the front wall. The remainder of the corner guard body is made from polyethylene. The leg structure is an integral metal unit having at least a pair of vertical legs and a horizontal connector joining the pair of legs, the connector abutting the rear wall of the body. The rear wall includes a projecting retainer housing with vertical passages for passage of the vertical legs, and a projecting stop for engaging the leg structure.

The above-described protective corner guard provides the desired protection to the corner at which it is mounted, and installation is made easier with only two legs to fix to the ground. However, the installation of the protective guard can be made difficult by the structure of the pair of vertical legs and a horizontal connector joining the pair of legs, in addition to the relatively thick and inflexible cross-section of the plastic body forming the corner shape. Such a design requires a significant degree of precision when one is forming the mounting holes in the ground or floor into which the legs are positioned to install the corner guard. If the mounting holes are not precisely spaced, the pair of legs may not fit well, and/or may not fit at all.

In addition, in some instances the plastic portion of the protective guard may not be sufficiently strong to withstand impact forces from collisions with various objects. For example, in warehouse environments, the size and bulk of carts and machinery can create substantial inertia that can overrun or snap the plastic molded bumper section of such conventional guards.

Accordingly, what is needed is a protective corner guard providing a sufficient and desired degree of protection of corners where collisions with heavier industrial-type equipment may occur, while also providing some degree of adjustment with regard to the installation of the protective corner guard. The present invention is directed to this need.

SUMMARY OF THE INVENTION

An embodiment of the present invention is a corner guard for protecting a corner of a structure from collision with objects. The corner guard includes a rigid body. The rigid body includes a base and an upper end. The rigid body also includes a wall extending between the base and the upper end that is configured to surround the corner of the structure. The wall has a front side facing away from the corner when installed and a back side facing toward the corner when installed. The rigid body further includes a leg structure secured to the rigid body. The leg structure includes at least two leg portions adapted to support the rigid body of the corner guard and the at least two leg portions are separated by a predetermined distance. The corner guard also includes an adjustment mechanism coupled to the rigid body. The adjustment mechanism is configured to apply a force to the rigid body to flex the rigid body to adjust the predetermined distance for installation of the at least two leg portions.

According to aspects of the present invention, the rigid body can be formed of a material with a tensile yield strength of greater than about 190 MPa. The rigid body can be formed of a composite material. The rigid body can be formed of a metal. The corner guard can likewise be formed of a material with a fracture toughness of greater than about 40 MPa-m$^{1/2}$. For example, the rigid body can be formed of a stainless steel.

According to further aspects of the present invention, the wall can include a surface feature projecting outward from the front side of the wall. The leg structure can be secured to the back side of the wall. The at least two leg portions can be joined by the adjustment mechanism.

According to further aspects of the present invention, the adjustment mechanism can be configured to apply a force to the corner guard to flex the rigid body to increase or decrease the predetermined distance. The adjustment mechanism can be adapted to apply a force to the corner guard to flex the rigid body to adjust the predetermined distance by a distance of at least 0.25 inches. The adjustment mechanism can include a cylindrical portion with a First end, a second end, and a cylindrical axis extending through the center and along the length of the cylindrical portion. The cylindrical portion is threaded in a first orientation at a first end and the cylindrical portion is reverse threaded at a second end. The adjustment mechanism can also include a first coupling configured to couple the threaded first end of the cylindrical portion to the rigid body, and a second coupling configured to couple the threaded second end of the cylindrical portion to the rigid body. Rotation of the cylindrical portion about the cylindrical axis in a first direction applies a force to flex the rigid body to reduce the predetermined distance, and rotation of the cylindrical portion about the cylindrical axis in a second direction applies a force to flex the rigid body to increase the predetermined distance.

According to additional aspects of the present invention, the wall can include a front right side face and a front left side face, wherein the front right side face and the front left side face form an arcuate shape. The wall can include a front right side face and a front left side face where the front right side face and the front left side face meet in a rounded corner.

BRIEF DESCRIPTION OF THE DRAWINGS

The present invention will become better understood with reference to the following description and accompanying drawings, wherein.

DETAILED DESCRIPTION

Figure 1:
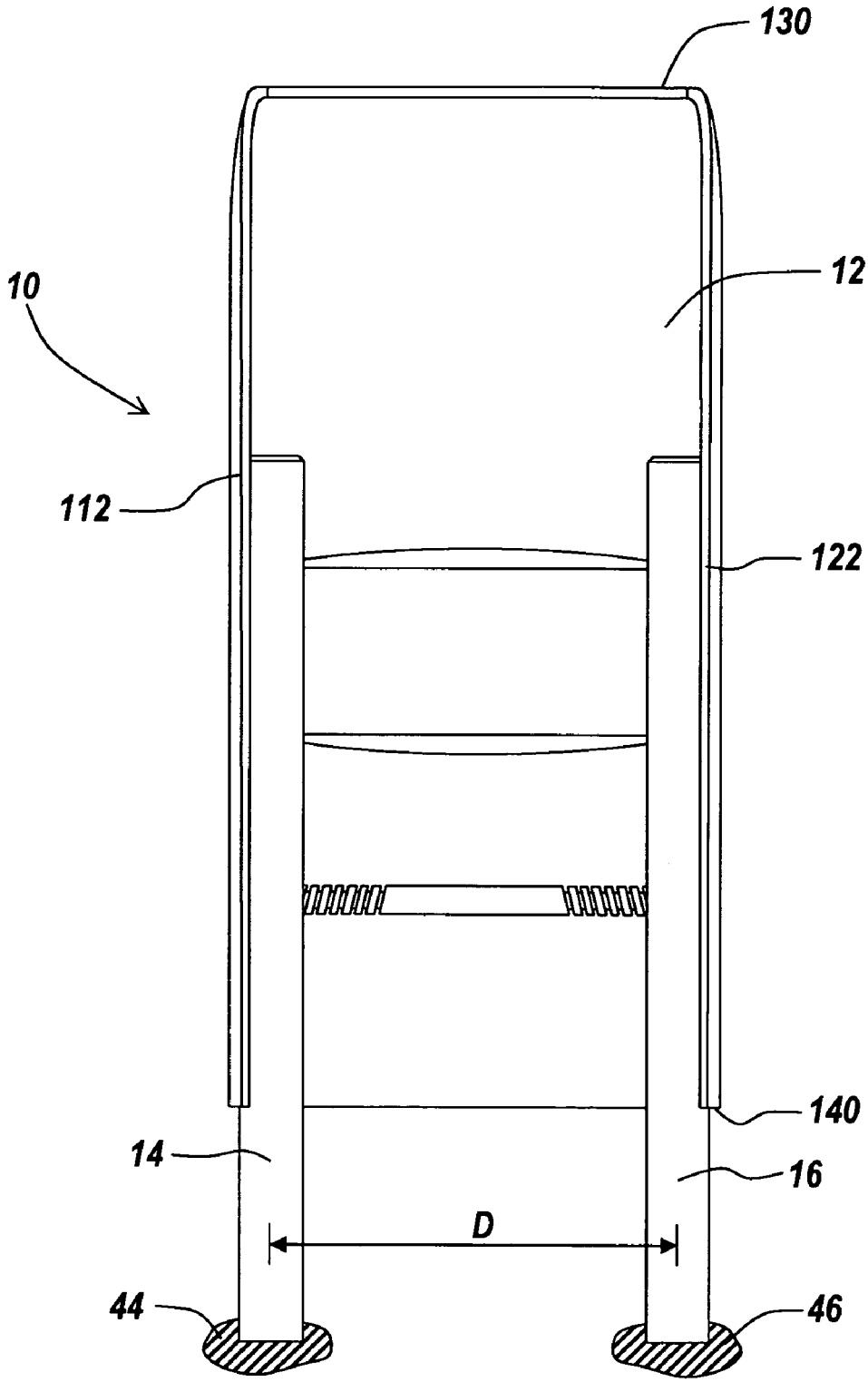
FIG. 1 is a diagrammatic back view of an adjustable rigid corner guard, according to one aspect of the present invention.
Figure 2:
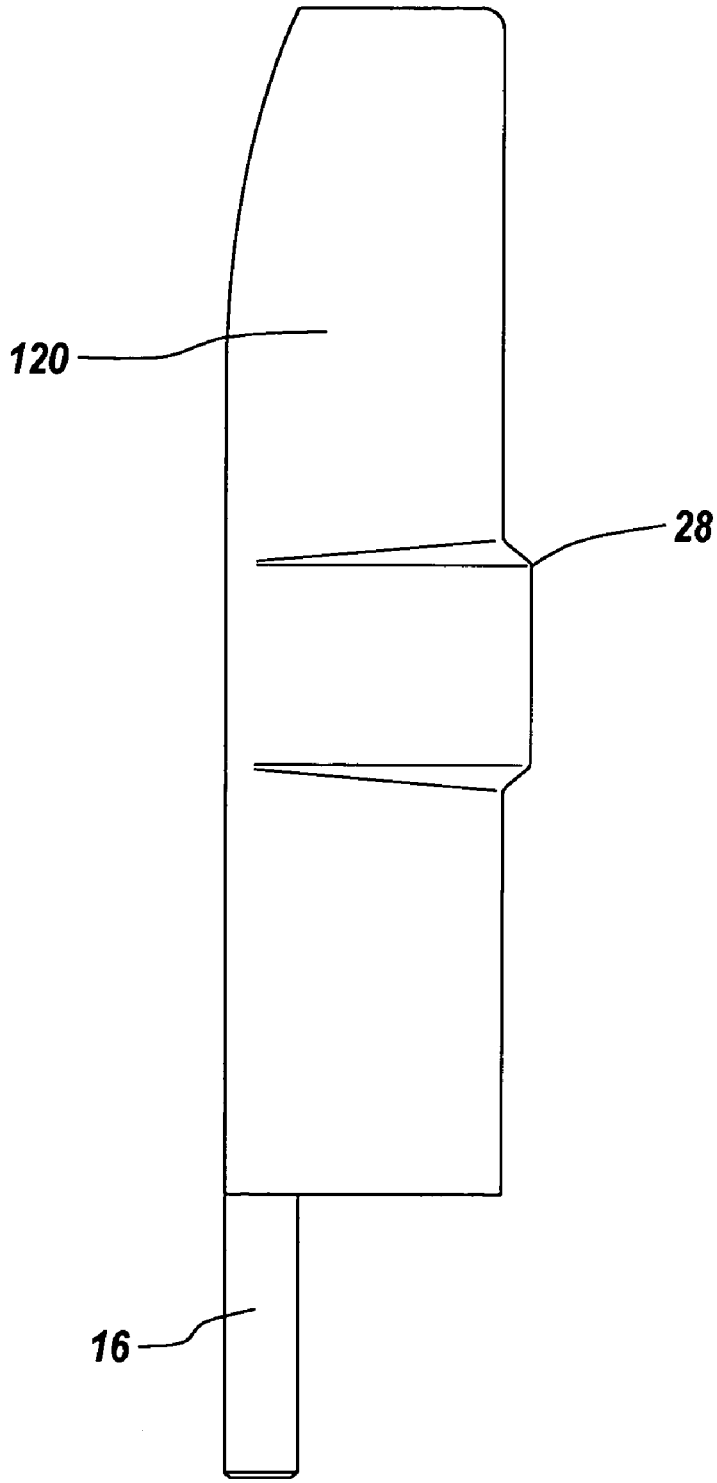
FIG. 2 is a diagrammatic side view of the adjustable rigid corner guard, according to one aspect of the present invention.

An illustrative embodiment of the present invention relates to an improved corner guard, in which one embodiment is formed of a rigid body to absorb impact forces and protect floor fixtures from collisions. The rigid body is constructed of a material, such as a metal or heavy composite for ease of cleaning and for good stability and impact absorption ability. Other types of material are considered within the scope of the invention. The material must be sturdy enough to absorb the impact of many collisions while maintaining an attractive appearance, and not easily fracturing or denting. One embodiment of the present invention further includes at least two legs that support the rigid body. The distance dimension between the legs is adjustable to enable minor variations in the placement of the mounting holes into which the legs fit to install the corner guard in the ground or floor.

FIGS. 1 through 7B, wherein like parts are designated by like reference numerals throughout, illustrate an example embodiment of an adjustable corner guard according to the present invention. Although the present invention will be described with reference to the example embodiment illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

FIG. 1 is a back view of an adjustable rigid corner guard 10 in accordance with one embodiment of the present invention. The adjustable rigid corner guard 10 has a bumper section 12, which serves to protect a corner upon which, or in front of which, the adjustable rigid corner guard 10 is mounted. The bumper section 12 can be formed of a number of different rigid and high strength materials, such as metal and high strength composites, and the like, to create a rigid body, so long as the material provides sufficient support and durability to protect a corner. The ability of a particular material to resist being dented or cracked when impacted with an object depends on the yield strength of the particular material (the force a material can withstand before being irreversibly deformed) and the facture toughness of the particular material (the material's resistance to brittle fracture when a crack is present). A material must have sufficient strength to resist being dented or deformed to be useful as a rigid corner guard. The tensile yield strength, expressed in units of millions of Pascals (MPa), is a standard measure of material strength. A material with sufficient strength may not be suitable for use as a corner guard because it may not be sufficiently tough. Such a material would not dent or deform during a collision, but it would crack. The fracture toughness, expressed in units of millions of Pascals multiplied by square root meters (MPa-$m^{1/2}$), is a standard measure of material toughness. The yield strength is normally expressed in units of millions of Pascals (MPa) and the fracture toughness is normally expressed in units of millions of Pascals multiplied by square root meters (MPa$\sqrt{m}$ or MPa-$m^{1/2}$).

In accordance with one example embodiment, the bumper section 12 is formed of a stainless steel metal. Table 1 shows yield strengths for readily available stainless steels, a common aluminum alloy, and two types of high density polyethylene (HDPE). As described above, many conventional corner guards are formed of plastics such as HDPE and lightweight aluminum. However, most plastics and many aluminum alloys do not have sufficient strength for use in a corner guard where collisions with heavier industrial type equipment can occur. The yield strength of most metal materials (pure and alloys) depends both on the chemical composition of the metal material and the way that the metal material is processed. Cold working and/or annealing of a metal material can greatly increase its strength. For this reason, typical values of yield strength for a particular metal material composition may cover a large range.

As can be seen in Table #1, aluminum alloys are much stronger than plastics, such as impact resistant HDPE. Some aluminum alloys are as strong as some types of stainless steel alloys, but the range of strengths is higher for stainless steel than for aluminum alloys. Additionally, stainless steel alloys are more tough (resistant to fracture) than aluminum alloys.

TABLE #1

| Material | Tensile Yield Strength in MPa | Fracture Toughness ($K_{1C}$) in MPa-m$^{1/2}$ |
|---|---|---|
| Stainless Steel AISI type 300 series | 210-415 (range includes 304, 304L, 304N and 304HN) | 100 (typical value for AISI 300 series) |
| Al alloy 6061-T6 | 276 (typical value) | 29 (typical value) |
| High Density Polyethelene (HDPE), impact grade | 17-25 MPa (typical values) | ~1 |
| HDPE, ultra high molecular weight | 20-28 MPa (typical values) | ~1 |

Materials with a tensile yield strength of greater than about 190 Mpa and a fracture toughness greater than about 40 MPa-m$^{1/2}$ are sufficiently strong and tough to withstand collisions with heavier industrial type collisions.

The adjustable rigid corner guard 10 further includes two or more legs, such as a first leg 14 and a second leg 16, upon which the bumper section rests. The first and second legs 14, 16 are preferably fabricated from stainless steel to provide strength when the bumper section 12 receives an impact blow. Other materials may, of course, be utilized as long as the appropriate strength is retained, and first and second legs 14, 16 do not break under predictable impact. The first and second legs 14, 16 are spaced a distance D apart.

Figure 3A:
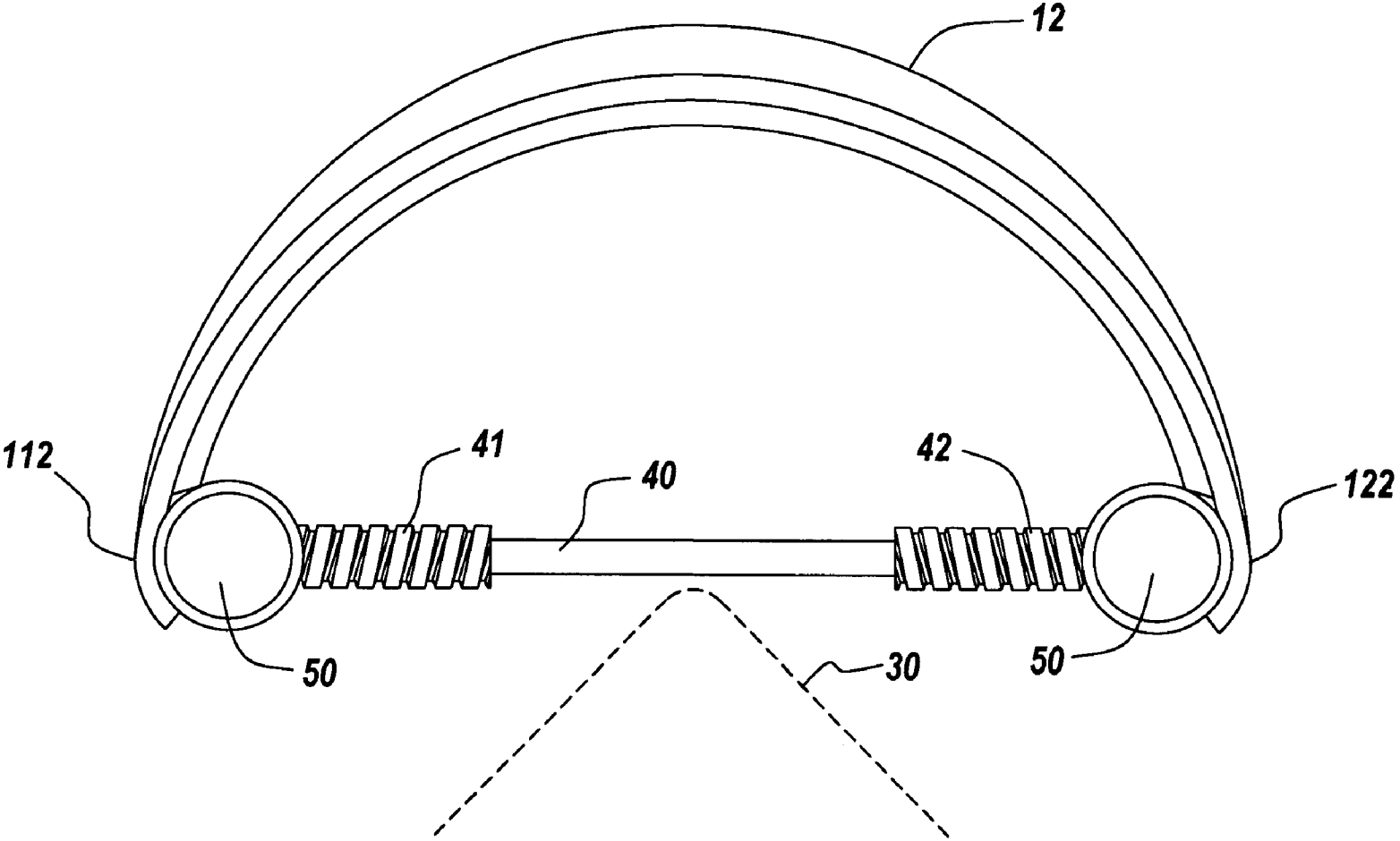
FIG. 3A is a diagrammatic top view of the adjustable rigid corner guard, according to one aspect of the present invention.
Figure 3B:
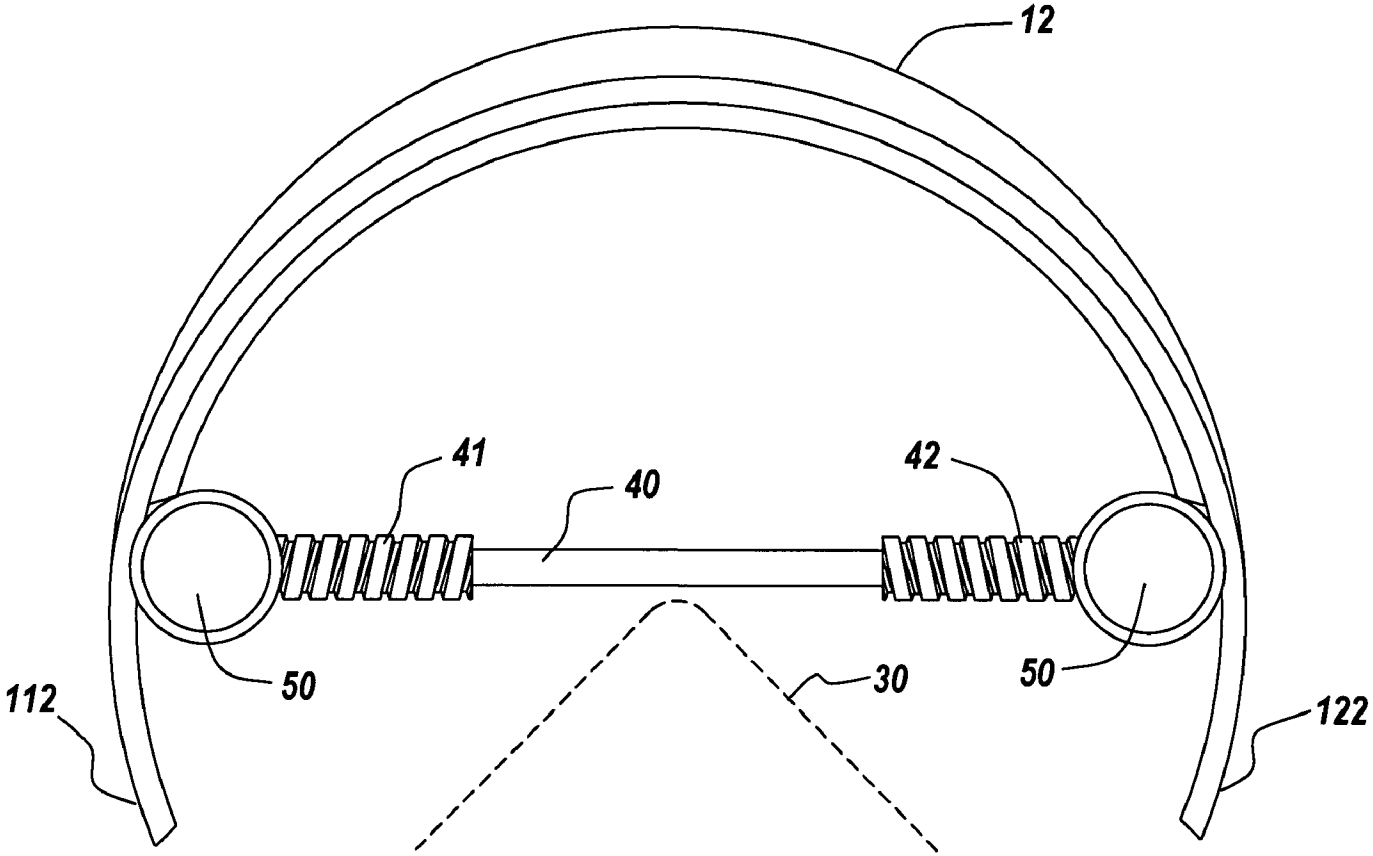
FIG. 3B is a diagrammatic top view of the adjustable rigid corner guard where a bumper section extends laterally significantly beyond a leg structure, according to one aspect of the present invention.
Figure 4A:
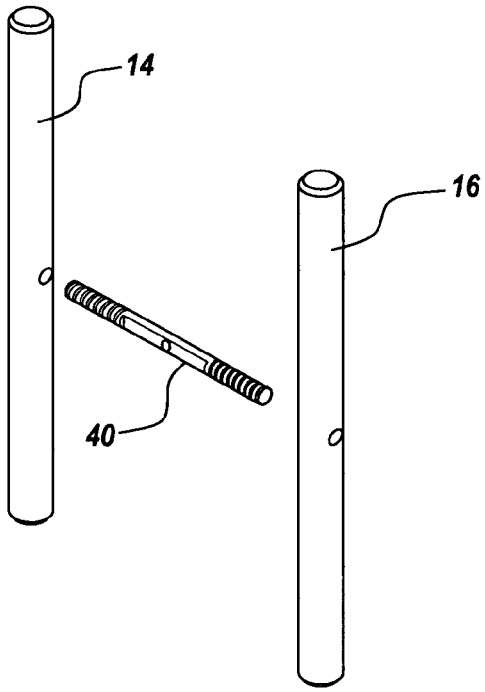
FIG. 4A is an exploded perspective view of the legs and adjustment mechanism of the corner guard, according to one aspect of the present invention.
Figure 4B:
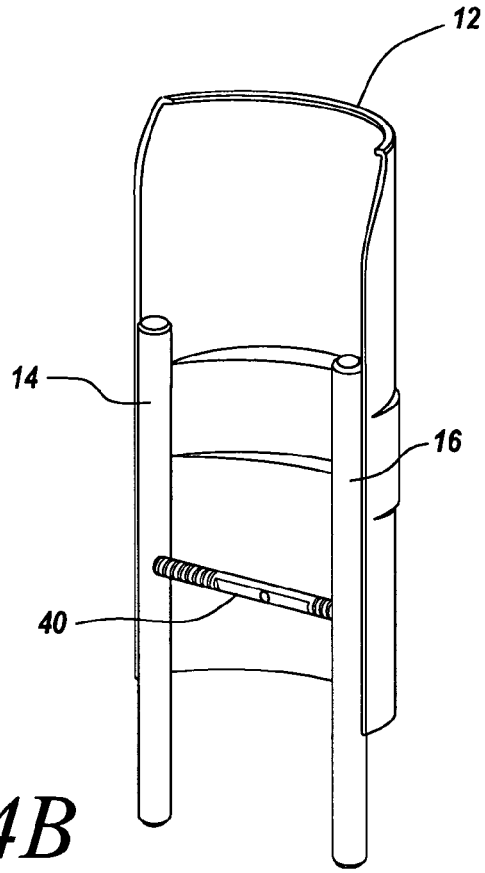
FIG. 4B is a perspective view of the legs and adjustment mechanism of the corner guard assembled, according to one aspect of the present invention.

The adjustable rigid corner guard 10 can have a number of different configurations, while still providing the desired level of protection of a corner upon which, or in front of which, it mounts. Referring now to FIGS. 1-7B, one example embodiment will now be described. Primarily, the adjustable rigid corner guard 10 is configured for absorbing the impact of collisions and protecting corners of fixtures and/or walls. The bumper section 12 includes a front right side face 110 and a front left side face 120. The front right side face 110 and front left side face 120 are essentially opposite ends of a generally arcuate shaped horizontal cross-section. However, the front right side face 110 and front left side face 120 can likewise be substantially orthogonal to each other and meet in a rounded edge in-between; or alternatively may intersect at other angles other than the perpendicular, so as to surround the periphery of a corner 30. Both the front right side face 110 and the front left side face 120 provide an extended vertical surface to protect the corner 30 adequately. A right side edge 112 and a left side edge 122 are preferably beveled, as is a top 130 of the bumper section 12, and also the base 140, in order to eliminate any sharp edges on the adjustable rigid corner guard 10. However, other types of edge finishes are considered within the scope of the invention. The front wall, formed by the front right side face 110 and front left side face 120, essentially surrounds the corner 30 of a structure that is to be protected. Additionally, the rigid body 12 can extend laterally substantially beyond the leg structure as shown in FIG. 3B. This obscures the view of the back side of the bumper section 12 of the corner guard 10 after installation, and may provide a greater area of protection for the corner 30 of the structure.

In accordance with one example embodiment of the present invention, the adjustable rigid corner guard 10 includes a rub rail 28 that extends horizontally across the right side face 110 to the left side face 120 of the adjustable rigid corner guard 10. The rub rail 28 runs parallel to the base and forms a bulge or outwardly projecting surface feature in the front of the bumper section 12, extending outwardly from the front wall, to receive the initial impact of any collision. The rub rail 28 is integral with the bumper section 12. It should be noted that the configuration of the rub rail 28 can vary, such that other type protrusions, such as a wedge or rectangular bulge, can form the rub rail within the scope of the present invention, such that the rub rail 28 is not limited to the configuration illustrated herein.

Figure 5:
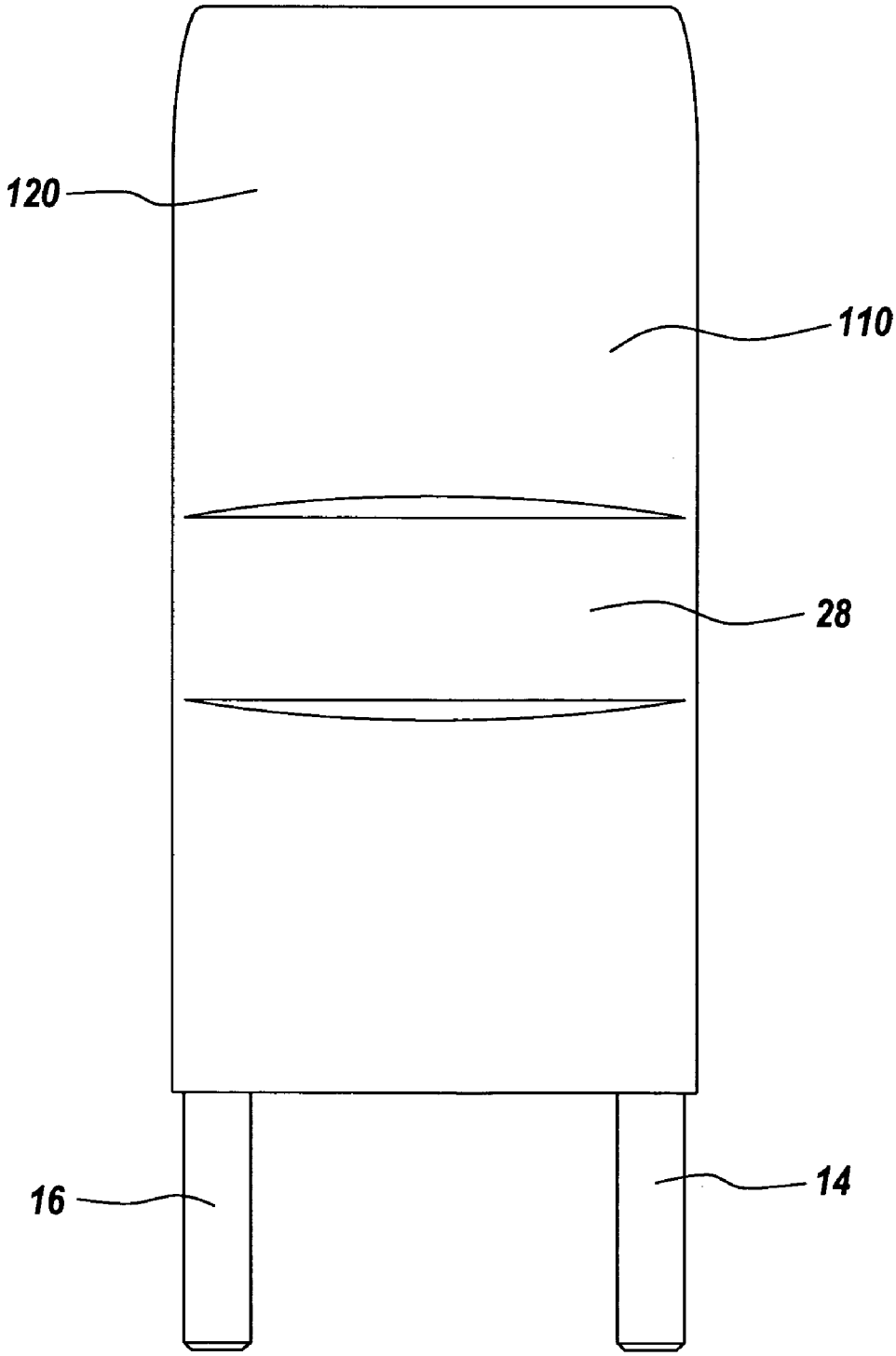
FIG. 5 is a front view of the adjustable rigid corner guard with a rub rail, according to one aspect of the present invention.
Figure 6:
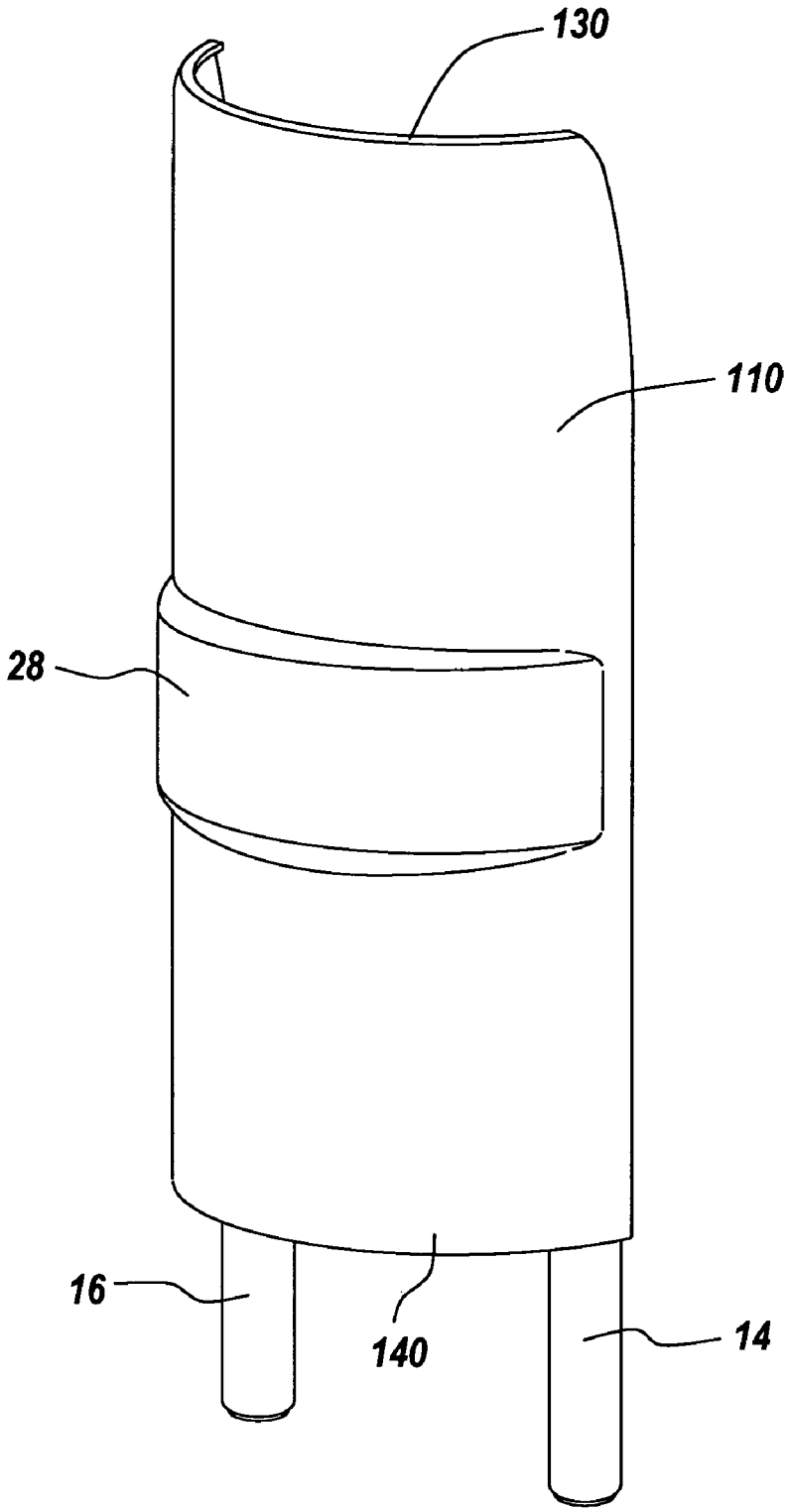
FIG. 6 is a perspective view of the front of the adjustable rigid corner guard, according to one aspect of the present invention.

Referring now to FIGS. 5 and 6, the vertical height of bumper section 12 is designed to be substantially larger than the width of either the front right side face 110 or the front left side face 120. The rub rail 28, which extends horizontally across the front right face 110 and the front left face 120 is positioned a short distance up from the base, and protrudes a short distance out from the respective front right and left faces 110 and 120.

Referring back to FIG. 3, FIG. 4A, and FIG. 4B, there is shown a top view of the adjustable rigid corner guard 10, and two perspective views. The difficulty in making a corner guard with a rigid body that is strong enough to withstand impacts from heavy machinery or objects, potentially at higher velocities, is that the installation of such a guard can be hindered by slight variances in the distance between the mounting holes into which the legs of the guard are placed. With a softer material used to form the main body of the corner guard, the body can be compressed or slightly deformed to adjust the distance between the two or more legs to enable them to fit in existing mounting hose. However, if the body is too rigid (to withstand greater impacts) it can be very difficult to still maintain some flexibility in the placement of the mounting holes relative to the distance between the supporting legs of the guard. With the present invention, an adjustment mechanism 40 is provided that includes a rod with opposite orientation threading 41, 42. In the example embodiment illustrated, the rod of the adjustment mechanism 40 extends between the right side edge 112 and left side edge 122 of the bumper section 12. The adjustment mechanism couples with the right side edge 112 and left side edge 122 at couplings 50. The couplings 50 can be fixed or can provide some rotation or pivoting capability, if desired, to allow rotation about a vertical axis through the couplings. The adjustment mechanism 40 includes the opposite orientation threading 41, 42, which operates to pull the right side edge 112 and left side edge 122 closer together when rotated in a first direction, and to push the right side edge 112 and left side edge 122 farther apart when rotated in an opposite direction.

With the rotation of the adjustment mechanism 40 in the first direction to pull the right and left side edges 112, 122 together, contemporaneous movement of the first and second legs 14, 16 occurs, and the distance D therebetween is reduced. With the rotation of the adjustment mechanism 40 in the opposite second direction to push the right and left side edges 112, 122 apart, contemporaneous movement of the first and second legs 14, 16 occurs, and the distance D therebetween is increased.

One of ordinary skill in the art will appreciate that the first and second leg supports 18, 20 can take a number of different forms, and are merely intended to provide sufficient support coupling the bumper section 12 with the first and second legs 14, 16 in a manner that will allow the adjustable rigid corner guard 10 to receive predictable impact levels from carts, and the like, as described, while protecting the corner 30 in front of which the adjustable rigid corner guard 10 is mounted.

The primary function of the adjustment mechanism 40 is to couple the front right face section 110 and the front left face section 112 together in a manner that enables or allows for a flexing of the bumper section 12 of the adjustable rigid corner guard 10 to affect the distance D between the first and second legs 14, 16 when installing the rigid corner guard 10. The flexing of the bumper section 12 along provides both increasing and decreasing adjustment of the distance D between the first leg 14 and the second leg 16. As such, if during an installation process, mounting holes 44 and 46 into which the first leg 14 and the second leg 16 are intended to fit are not precisely spaced at the exact distance between the first leg 14 and the second leg 16 without flexing the bumper section 12, then a user performing the installation can adjust the distance D as necessary using the adjustment mechanism 40.

Specifically, during installation the distance D can be adjusted by an installer by applying a force to the front right face section 110 and the front left face section 112, either expanding them apart to increase distance D or compressing them together to decrease distance D. Thus, if any minor adjustments are required based on the placement of the mounting holes 44, 46 in the ground, the installer can flex the bumper section 12 using the adjustment mechanism 40, to line up the first and second legs 14, 16 to match up with the mounting holes 44, 46.

It should be noted that in the illustrative embodiment the first and second legs 14, 16 are welded to the bumper section 12 of the adjustable rigid corner guard 10. Accordingly, the adjustable rigid corner guard 10 maintains superior strength and impact resistance properties to plastic bumpers, while still having the ability to accommodate minor installation misalignments.

In accordance with one example embodiment, several adjustable rigid corner guards 10 were constructed. The bumper sections 12 ranged between 12 inches in height, to 18 inches in height, to 24 inches in height. With such dimensions, the flexibility provided by the adjustment mechanism 40 enabled variation of the dimension D between the first and second legs 14, 16 on the order of about ¼ inch in each direction (increasing and decreasing).

Figure 7A:
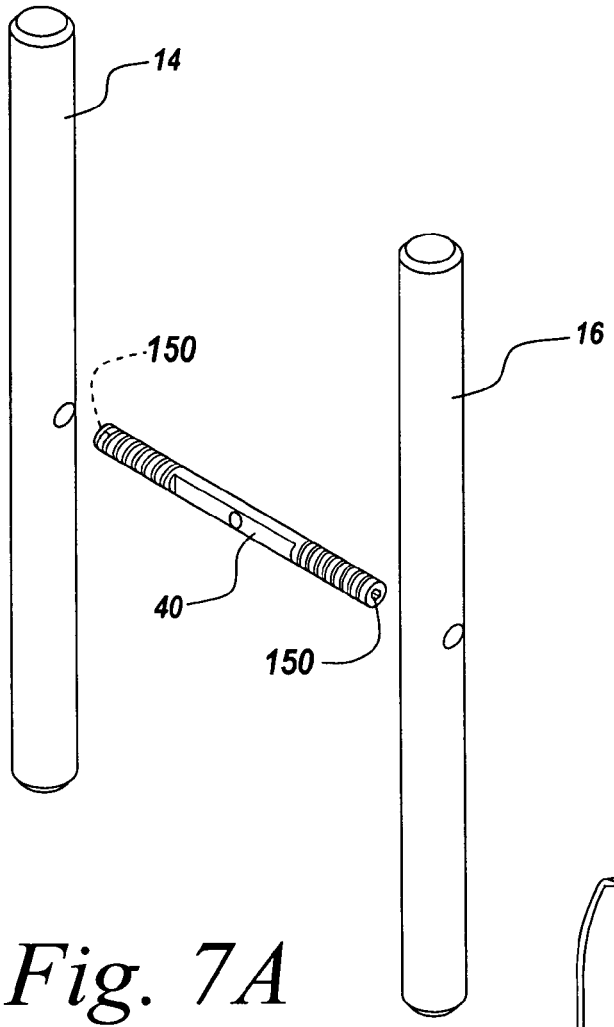
FIG. 7A is an exploded perspective view of the legs and adjustment mechanism of the corner guard where the adjustment mechanism includes hexagonal sockets, according to one aspect of the present invention.
Figure 7B:
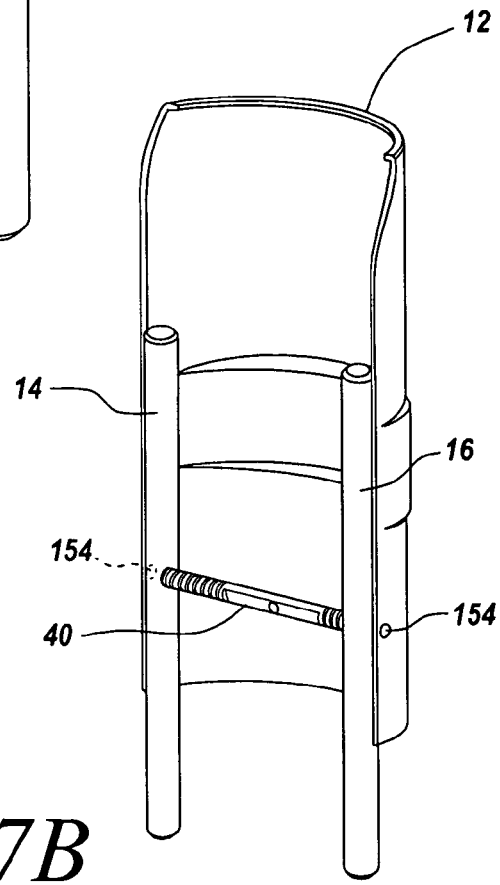
FIG. 7B is a perspective view of the legs, adjustment mechanism, and the bumper section of the corner guard assembled where the bumper section includes adjustment access holes, according to one aspect of the present invention.

Another illustrative embodiment shown in FIGS. 7A and 7B, allows the installer to change the distance D from a front of the bumper section 12, without necessarily requiring access to a back of the bumper section 12. The adjustment mechanism 40 has hexagonal sockets 150 at both ends that allow rotation of the adjustment mechanism 40 using a hexagonal wrench or an alien wrench. The bumper section 12 has adjustment access holes 154 that allow access to the hexagonal sockets 150 from the front side of the bumper section 12. An installer could move the adjustable corner guard 10 to near its installed position and then change the distance D from the front side of the bumper section 12 using a hexagonal wrench or an alien wrench. After the adjustable bumper guard 10 is installed, the adjustable bumper guard 10 could be secured or "locked into position" by changing the distance D, causing transverse frictional forces between the legs 14, 16 and the sides of the holes in which they are mounted.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the invention, and exclusive use of all modifications that come within the scope of the appended claims is reserved.

What is claimed is:

1. A corner guard for protecting a corner of a structure from collision with objects, comprising:

a rigid body, comprising:

a wall having a base and an upper end;

wherein the wall extends between the base and the upper end, the wall having a front side facing away from the structure when installed and a back side facing toward the structure when installed;

A leg structure secured to the rigid body, the leg structure including at least two leg portions supporting the rigid body of the corner guard, the at least two leg portions separated by a predetermined distance and configured to extend below the base end of the rigid body for insertion into corresponding mounting holes; and an adjustment mechanism coupled to the rigid body to forcibly hold the at least two leg portions at a desired distance other than the predetermined distance from each other;

wherein the adjustment mechanism applies:

a continuous tension force to the rigid body flexing the rigid body to decrease the predetermined distance of the at least two leg portions when the desired distance is less than the predetermined distance, and a continuous compression force to the rigid body flexing the rigid body to increase the predetermined distance of the at least two leg portions when the desired distance is greater than the predetermined distance.

2. The corner guard of claim 1, wherein the rigid body is formed of a material with a yield strength of greater than about 190 MPa.

3. The corner guard of claim 2, wherein the rigid body is formed of a composite material.

4. The corner guard of claim 2, wherein the rigid body is formed of a metal.

5. The corner guard of claim 2, wherein the rigid body is formed of a material with a fracture toughness of greater than about 40 MPa-$m^{1/2}$.

6. The corner guard of claim 1, wherein the rigid body is formed of a stainless steel.

7. The corner guard of claim 1, wherein the wall comprises a surface feature projecting outward from the front side of the wall.

8. The corner guard of claim 1, wherein the leg structure is secured to the back side of the wall.

9. The corner guard of claim 1, wherein the at least two leg portions are joined by the adjustment mechanism.

10. The corner guard of claim 1, wherein the adjustment mechanism applies a force to the corner guard to flex the rigid body to adjust the predetermined distance by a distance of at least about 0.25 inches.

11. The corner guard of claim 1, wherein the adjustment mechanism comprises:

a cylindrical portion with a first end, a second end, and a cylindrical axis extending through the center and along the length of the cylindrical portion, wherein the cylindrical portion is threaded in a first orientation at a first end and wherein the cylindrical portion is reverse threaded at a second end;

a first coupling that coupled with the threaded first end of the cylindrical portion to the rigid body; and a second coupling that coupled with the threaded second end of the cylindrical portion to the rigid body;

wherein rotation of the cylindrical portion about the cylindrical axis in a first direction applies a force to flex the rigid body to reduce the predetermined distance, and wherein rotation of the cylindrical portion about the cylindrical axis in a second direction applies a force to flex the rigid body to increase the predetermined distance.

12. The corner guard of claim 1, wherein the wall comprises a front right side face and a front left side face and wherein the front fight side face and the front left side face form an arcuate shape.

13. The corner guard of claim 1, wherein the wall comprises a front right side face and a front left side face and wherein the front right side face and the front left side face meet in a rounded corner.

14. A corner guard for protecting a corner of a structure from collision with objects, comprising:

a rigid body having a base end, an upper end, and a wall extending therebetween, wherein the wall comprises a surface feature formed integrally with the wall, the surface feature projecting outward from a front side of the wall;

A leg structure secured to the rigid body, the leg structure including at least two leg portions supporting the rigid body, the at least two leg portions separated by a predetermined distance and configured to extend below the base end of the rigid body for insertion into corresponding mounting holes; and an adjustment mechanism coupled to the rigid body to forcibly hold the at least two leg portions at a desired distance other than the predetermined distance from each other;

wherein the adjustment mechanism applies:

a continuous tension force to the rigid body flexing the rigid body to decrease the predetermined distance between the at least two leg portions for installation when the desired distance is less than the predetermined distance, and a continuous compression force to the rigid body flexing the rigid body to increase the predetermined distance between the at least two leg portions for installation when the desired distance is greater than the predetermined distance.

15. The corner guard of claim 14, wherein the rigid body is formed of a material with a yield strength of greater than about 190 MPa.

16. The corner guard of claim 14, wherein the rigid body is formed of a material with a fracture toughness of greater than about 40 MPa-$m^{1/2}$.

17. The corner guard of claim 14, wherein the leg structure is secured to a back side of the wall.

18. The corner guard of claim 14, wherein the at least two leg portions are joined by the adjustment mechanism.

19. The corner guard of claim 14, wherein the rigid body and the adjustment mechanism adjust the predetermined distance from a front side of the wall.

* * * * *